US008904681B2

(12) United States Patent
Pan

(10) Patent No.: US 8,904,681 B2
(45) Date of Patent: Dec. 9, 2014

(54) ELECTRIC FIREPLACE AND FLAME SIMULATOR THEREOF

(71) Applicant: Liping Pan, Zhejiang (CN)

(72) Inventor: Liping Pan, Zhejiang (CN)

( * ) Notice: Subject to any disclaimer, the term of this patent is extended or adjusted under 35 U.S.C. 154(b) by 0 days.

(21) Appl. No.: 14/346,323

(22) PCT Filed: Nov. 9, 2012

(86) PCT No.: PCT/CN2012/084419

§ 371 (c)(1), (2), (4) Date: Mar. 21, 2014

(87) PCT Pub. No.: WO2013/067970

PCT Pub. Date: May 16, 2013

(65) Prior Publication Data

US 2014/0250747 A1 Sep. 11, 2014

(30) Foreign Application Priority Data

Nov. 10, 2011 (CN) ..... 2011 2 0443338 U

(51) Int. Cl.

| | |
|---|---|
| ***G09F 19/00*** | (2006.01) |
| ***F21S 10/04*** | (2006.01) |
| ***F24C 7/00*** | (2006.01) |
| ***F24B 1/18*** | (2006.01) |

(52) U.S. Cl.

CPC ..... *F24C 7/004* (2013.01); *F21S 10/046* (2013.01); *F24B 1/18* (2013.01); *F21S 10/04* (2013.01)

USPC ..... 40/428

(58) Field of Classification Search

CPC ..... F21S 10/046; F21S 10/04

USPC ..... 40/428

See application file for complete search history.

(56) References Cited

U.S. PATENT DOCUMENTS

| | | | | |
|---|---|---|---|---|
| RE24,399 | E * | 12/1957 | Brooks | 40/428 |
| 2,963,807 | A * | 12/1960 | Relph et al. | 40/428 |
| 7,210,256 | B2 * | 5/2007 | Rosserot | 40/428 |
| 2002/0168182 | A1 | 11/2002 | Martin et al. | |
| 2003/0049024 | A1 * | 3/2003 | Chen | 392/348 |
| 2003/0072565 | A1 * | 4/2003 | Ravnbo-West et al. | 392/348 |
| 2005/0252051 | A1 * | 11/2005 | Chen | 40/428 |
| 2006/0213097 | A1 * | 9/2006 | Haugom | 40/428 |
| 2007/0240344 | A1 * | 10/2007 | Wei et al. | 40/428 |

* cited by examiner

*Primary Examiner* — Gary Hoge

(57) ABSTRACT

A flame simulator of an electric fireplace, including: a light source (1); a flame board (3); a flame projection screen (4); and a rotary drum (2); wherein the light source (1) is provided in the rotary drum (2); the rotary drum (2) is transparent and a light-concentrating block (20) is provided on a surface thereof; a flame pattern (31) is provided on the flame board (3); light concentrated by the light-concentrating block (20) is projected onto the flame board (3) and reflected by the flame board (3) to the flame projection screen (4) for forming a flame image. The flame is bright and has a sufficient dynamic effect. The rotary drum (2) and the light-concentrating block (20) can be made by injection molding for a simple structure and convenient production.

14 Claims, 3 Drawing Sheets

ELECTRIC FIREPLACE AND FLAME SIMULATOR THEREOF

CROSS REFERENCE OF RELATED APPLICATION

This is a U.S. National Stage under 35 U.S.C. 371 of the International Application PCT/CN2012/084419, filed Nov. 9, 2012, which claims priority under 35 U.S.C. 119(a-d) to CN 2011204433386, filed Nov. 10, 2011.

BACKGROUND OF THE PRESENT INVENTION

1. Field of Invention

The present invention relates to an electric fireplace.

2. Description of Related Arts

Flame simulator of an electric fireplace usually utilizes electrical flame or simulated flame. The flame is not used for heating, but for visual effects and decoration.

A conventional electric fireplace with a flame simulator generally comprises two parts: a blowing heater and a flame simulator. Usually, there are two types of flame simulator. The first type utilizes a set of streamers hanging above a simulated burning object and behind a translucent plastic screen and mirror glass. The streamers blowing by air are projected onto the glass surface and flickering lights are formed for simulating the burning flame. Although the flickering visual effect of the flame is provided, spark movements due to intensely burning are not simulated. The second type installs a rotary light source driven by motor behind a simulated dendritic charcoal combustion medium and provides a flame-like wall, a translucent screen as well as a mirror glass in front of the rotary light source. The light from the rotary light source passes through flame holes on the fire wall for forming the shape of flame. Then the shape of flame is projected onto the translucent screen and the mirror glass for producing the visual effect of the jumping flame.

There are other types of flame simulator, but simulating effects thereof are not good enough, and producing methods thereof are complex.

SUMMARY OF THE PRESENT INVENTION

Technical Problem

An object of the present invention is to provide an electric fireplace and a flame simulator thereof for overcoming the disadvantages of the conventional technology, wherein a producing method is simple and a flame effect is sufficient.

Technical Proposal

Accordingly, in order to accomplish the above object, the present invention provides a flame simulator for an electric fireplace, comprising:

a light source;

a flame board;

a flame projection screen; and a rotary drum;

wherein the light source is provided inside the rotary drum; the drum has a transparent body; a light-concentrating block is provided on a surface of the rotary drum; a flame pattern is provided on the flame board; light from the light-concentrating block is reflected by the flame board onto the flame projection screen for forming a flame image.

Preferably, the rotary drum is driven to rotate by a motor or other power.

Preferably, the rotary drum comprises a plurality of unit blocks spliced to each other.

Preferably, the rotary drum can be provided between the flame plate and the flame projection screen for shortening a thickness of the flame simulator, the rotary drum can also be provided in front of the flame projection screen.

Preferably, the rotary drum can be made of transparent plastic, and the rotary drum can also be made of other transparent materials. Preferably, the rotary drum is made of transparent organisms in such a manner that overall injection molding is convenient.

Preferably, a wood-shaped plastic block can be provided in front of the flame projection screen. The plastic block utilizes the light source in the rotary drum or other light sources. The light from the light source passes through the plastic block, and the plastic block provides a visual effect of burning wood.

Preferably, the electric fireplace comprises the flame simulator utilized in the electric fireplace, a frame and a heating device.

Preferably, decorations such as pebbles can be provided at a front portion of the electric fireplace.

Beneficial Effect

Therefore, because of the transparent rotary drum and the light-concentrating block, the flame is bright and has a sufficient dynamic effect.

The rotary drum and the light-concentrating block can be made by injection molding for a simple structure and convenient production.

These and other objectives, features, and advantages of the present invention will become apparent from the following detailed description, the accompanying drawings, and the appended claims.

DETAILED DESCRIPTION OF THE PREFERRED EMBODIMENT

Figure 1:
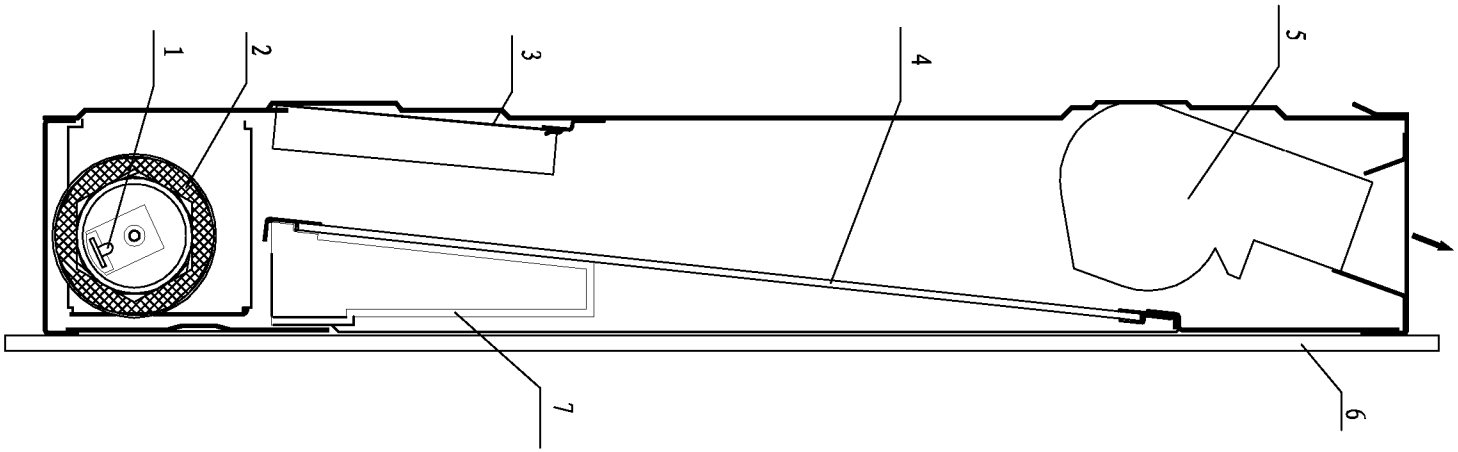
FIG. 1 is a structural sketch view of an electric fireplace and a flame simulator thereof according to a preferred embodiment of the present invention.
Figure 2:
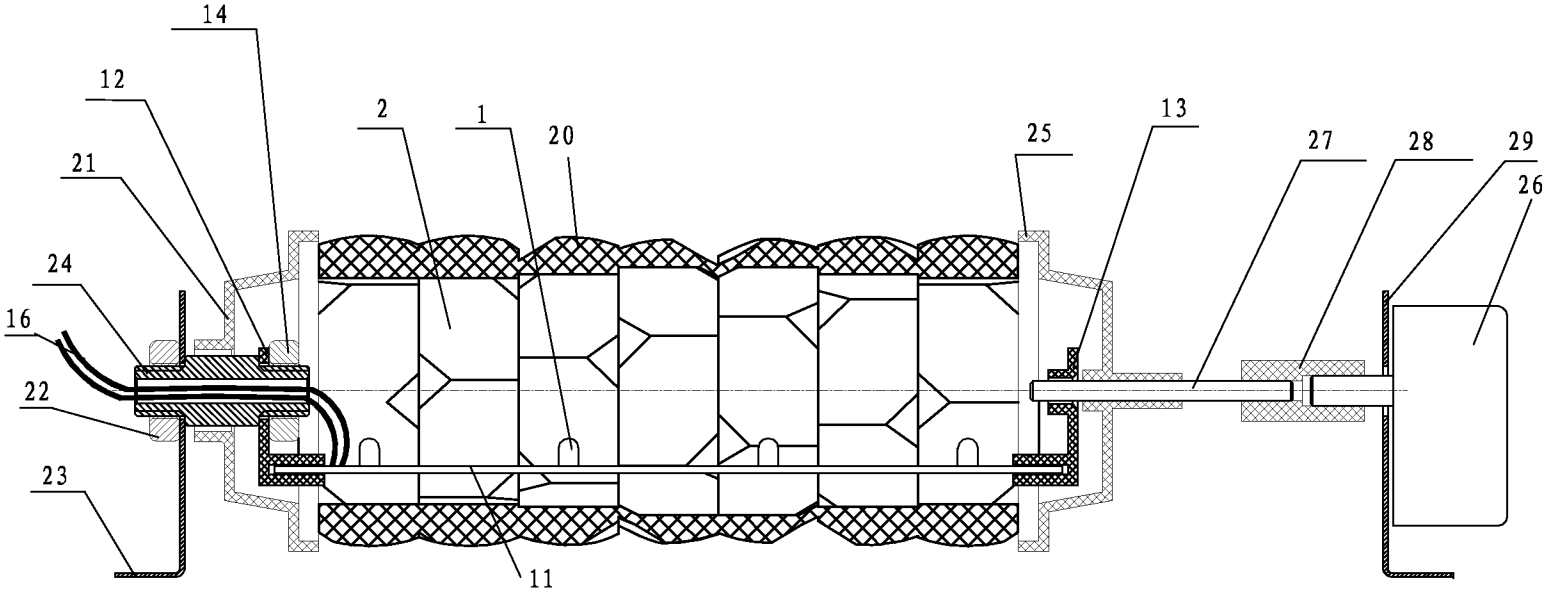
FIG. 2 is a structural sectional view of a rotary drum of the flame simulator according to the preferred embodiment of the present invention.

Referring to FIG. 1 and FIG. 2 of the drawings, a flame simulator of an electric fireplace according to a preferred embodiment of the present invention is illustrated, comprising:

a light source 1;

a flame board 3;

a flame projection screen 4; and a rotary drum 2.

The light source 1 is mounted on a light source holder 11. A left end and a right end of the light source holder 11 are respectively mounted on a left holder 12 and a right holder 13. The left holder 12 is mounted on a holder axle 24 by a nut 14. The holder axle 24 is mounted on a drum holder 23 by a fastening nut 22. The right holder 13 is mounted on a rotary axle 27. The rotary axle 27 is connected to a shaft of a motor 26 through a coupling 28. The motor 26 is supported by a motor holder 29.

The drum holder 23 and the motor holder 29 are all mounted on the electric fireplace.

The light source 1 is connected to a power source by a wire 16.

The rotary drum 2 has a transparent body. A light-concentrating block 20 is provided on a surface thereof. A left end of the transparent body is mounted on the holder axle 24 by a left end cap 21. A right end of the transparent body is mounted on the rotary axle 27 by a right end cap 25.

The motor 26 is connected to the power source by a wire. When the motor 26 rotates, the rotary drum 2 rotates therewith.

The light-concentrating block 20 can be provided on an inner surface or an outer surface of the rotary drum 2. According to the preferred embodiment, the light-concentrating block 20 is provided on the outer surface of the rotary drum 2.

Preferably, the rotary drum 2 has an integrated body and can be once-molded conveniently.

Preferably, a portion of the rotary drum 2 which contacts with the light-concentrating block 20 is transparent, and other portions are not transparent.

Figure 3:
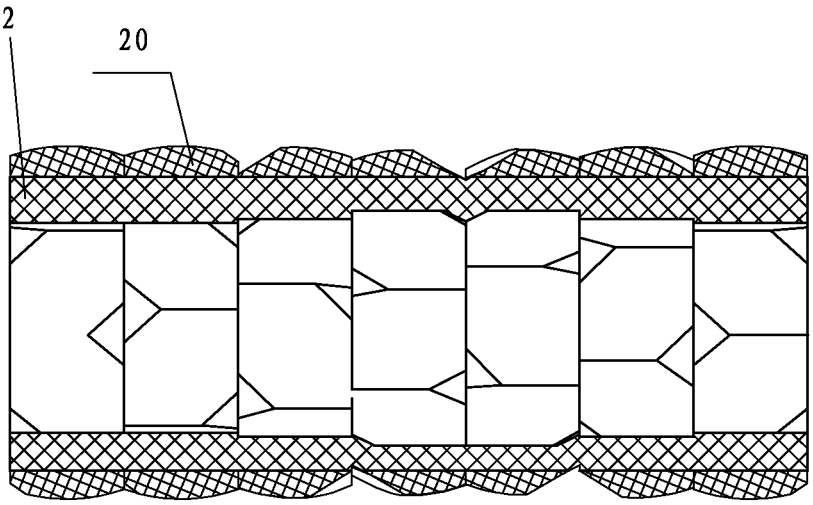
FIG. 3 is a structural sectional view of a rotary drum according to another preferred embodiment of the present invention.

Preferably, the light-concentrating block 20 and the rotary drum 2 can be a whole for being overall molded. The light-concentrating block 20 and the rotary drum 2 can also be produced separately and then mounting the light-concentrating block 20 on the rotary drum 2, as shown in FIG. 3.

Preferably, the light-concentrating block 20 is a convex lens in such a manner that a light-concentrating effect is improved and the flame projected onto the flame board is vivid.

A shape of the convex lens can be rectangular, circular, polygonal or other shapes.

An illuminating surface of the convex lens can be flat, spherical, curved, cambered or other shapes. The illuminating surface can also be a combination of the shapes.

Figure 5:
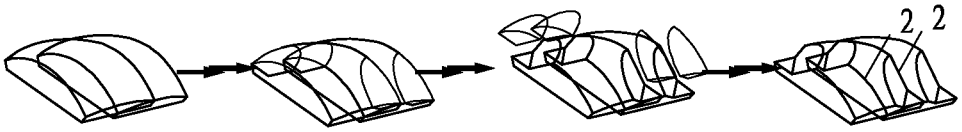
FIG. 5 is a structural sketch view of a changed convex lens according to the embodiment of the present inventions.

Preferably, a main body of the convex lens can be partially cut or extended, as shown in FIG. 5.

Figure 4:
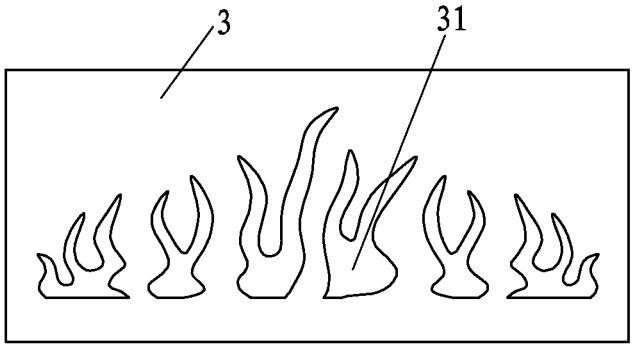
FIG. 4 is a structural sketch view of a flame board according to the preferred embodiment of the present invention.

Preferably, a flame pattern 31 is provided on the flame board 3, as shown in FIG. 4.

Preferably, the rotary drum 2 is provided in bottom front of the flame board 3. Light from the light-concentrating block 20 on the rotary drum 2, especially from the flame pattern 31, is projected onto the flame board 3. Then the light is reflected by the flame board 3 to the flame projection screen 4. Therefore, a flame image is formed on the flame projection screen 4.

During utilization, the light source 1 and the motor 26 are turned on, and the motor 26 drives the rotary drum 2 to rotate. The light from the light source 1 passes through the light-concentrating block 20 and is projected onto the flame pattern 31 on the flame board 3. After being reflected, the flame pattern 31 of the flame board 3 will be projected onto the flame projection screen 4 for forming the flame image. The light changes with the rotating rotary drum, is concentrated by the light-concentrating block 20 and is reflected by the flame pattern 31. Therefore, the whole flame pattern has a high contrast with a surrounding environment, and a realistic flame, a dynamic visual effect as well as a sufficient simulating effect are provided.

Referring to the FIG. 1, an electric fireplace comprising the above flame simulator is provided, wherein a blowing heater 5 is provided on the electric fireplace for heating the surrounding environment.

Preferably, the blowing heater 5 usually comprises:

a blower; and a heating element, wherein the heating element is provided in the blower, air is heated by the heating element and sent out by the blower. The heating device of the blowing heater 5 can also be replaced by other heating devices.

Preferably, the blowing heater 5 can be provided under the electric fireplace, and is reasonably arranged by utilizing a space of the electric fireplace space.

Preferably, glass 6 is provided in front of the electric fireplace. The flame projection screen 4 can be seen through the glass 6 in such a manner that the flame simulated on the flame projection screen 4 can be seen when the flame simulator is turned on.

Preferably, a simulacrum 7 of burning materials such as wood is provided at a lower front portion of the electric fireplace. With the light source 1 in the rotary drum 2 or other light sources, dark red light is provided on the simulacrum 7, which is similar to light of the burning wood.

Preferably, decorations such as pebbles can be provided at a front portion of the electric fireplace.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A flame simulator of an electric fireplace, comprising:

a light source;

a flame board;

a flame projection screen; and a rotary drum;

wherein said light source is provided inside said rotary drum; said drum has a transparent body; a light-concentrating block is provided on a surface of said rotary drum; a flame pattern is provided on said flame board; light from said light-concentrating block is reflected by said flame board onto said flame projection screen for forming a flame image.

2. The flame simulator, as recited in claim 1, wherein said light-concentrating block is a convex lens.

3. The flame simulator, as recited in claim 1, wherein said rotary drum and said light-concentrating block are made by injection molding.

4. The flame simulator, as recited in claim 2, wherein said rotary drum and said light-concentrating block are made by injection molding.

5. The flame simulator, as recited in claim 1, wherein said rotary drum and said light-concentrating block are made by injection molding and are spliced with each other.

6. The flame simulator, as recited in claim 2, wherein said rotary drum and said light-concentrating block are made by injection molding and are spliced with each other.

7. The flame simulator, as recited in claim 1, wherein said rotary drum and said light-concentrating block comprise a plurality of unit blocks spliced to each other.

8. The flame simulator, as recited in claim 2, wherein said rotary drum and said light-concentrating block comprise a plurality of unit blocks spliced to each other.

9. The flame simulator, as recited in claim 1, wherein a wood-shaped plastic block is provided in front of said flame projection screen.

10. The flame simulator, as recited in claim 2, wherein a wood-shaped plastic block is provided in front of said flame projection screen.

11. The flame simulator, as recited in claim 1, wherein said rotary drum is provided between said flame plate and said flame projection screen.

12. The flame simulator, as recited in claim 2, wherein said rotary drum is provided between said flame plate and said flame projection screen.

13. An electric fireplace, comprising: the flame simulator as recited in claim 1.

14. An electric fireplace, comprising: the flame simulator as recited in claim 2.

* * * * *